US006460546B1

(12) United States Patent
Sofer

(10) Patent No.: US 6,460,546 B1
(45) **Date of Patent: *Oct. 8, 2002**

(54) CARTRIDGE FOR HAIR DYE DISPENSER AND CORRESPONDING METHOD

(75) Inventor: Menachem Sofer, Ramle (IL)

(73) Assignee: Montec Product Devolopment Ltd., Ramat Hasharon (IL)

( * ) Notice: Subject to any disclaimer, the term of this patent is extended or adjusted under 35 U.S.C. 154(b) by 0 days.

This patent is subject to a terminal disclaimer.

(21) Appl. No.: 09/931,899

(22) Filed: Aug. 20, 2001

Related U.S. Application Data

(63) Continuation-in-part of application No. PCT/IL00/00100, filed on Feb. 17, 2000, which is a continuation-in-part of application No. 09/253,775, filed on Feb. 22, 1999, now Pat. No. 6,053,177.

(51) Int. Cl.[7] ..... A45D 24/26

(52) U.S. Cl. ..... 132/112; 132/116; 132/108; 401/176; 401/179

(58) Field of Search ..... 132/112, 113, 132/114, 115, 116, 108, 212, 208, 270, 272; 401/171, 176, 177, 179, 180, 181, 287, 290; 222/137, 145.5, 145.6, 326, 327

(56) References Cited

U.S. PATENT DOCUMENTS

| | | | | |
|---|---|---|---|---|
| 1,607,674 | A | * | 11/1926 | Ives |
| 3,952,920 | A | * | 4/1976 | Bergman |
| 4,934,388 | A | * | 6/1990 | Gibbs |
| 5,059,050 | A | * | 10/1991 | Guglielmo |
| 5,060,679 | A | * | 10/1991 | Christopher et al. |
| 5,333,627 | A | * | 8/1994 | Mehringer et al. |
| 6,053,177 | A | * | 4/2000 | Sofer |

FOREIGN PATENT DOCUMENTS

| | | |
|---|---|---|
| WO | WO 00/49907 | 8/2000 |

* cited by examiner

*Primary Examiner*—Pedro Philogene
(74) *Attorney, Agent, or Firm*—Mark M. Friedman

(57) ABSTRACT

A cartridge for use in a hair dye dispenser includes a dispensing container for containing and dispensing the hair dye, the dispensing container having a base and at least one side wall sealingly attached to or integrally formed with the base so as to define an internal volume of the dispensing container. The base has a lower surface that is formed with a number of projecting tines and at least one dispensing aperture. A piston is configured to fit closely in sliding abutment with the at least one side wall so as to be sealingly slidable towards the base.

17 Claims, 4 Drawing Sheets

CARTRIDGE FOR HAIR DYE DISPENSER AND CORRESPONDING METHOD

This is a continuation-in-part of PCT Application No. PCT/IL00/00100 filed Feb. 17, 2000 which is itself a continuation-in-part of U.S. patent application Ser. No. 09/253,775 filed Feb. 22, 1999 which is now issued as U.S. Pat. No. 6,053,177.

FIELD AND BACKGROUND OF THE INVENTION

The present invention relates to hair dye dispensers and, in particular, it concerns a cartridge for use with such a dispenser and a method of using such a cartridge.

It is known to provide a hair dye dispenser for dispensing dye into the hair of a user. Of particular relevance to the present invention is a hair dye dispenser disclosed in PCT Patent Publication No. WO 98/51183 which is hereby incorporated by reference as if set out in its entirety herein. The dispenser in question will now be described with reference to FIG. 1 which corresponds to FIG. 2 of the aforementioned application. For the sake of clarity, the original numerals will be identified within parentheses. Thus, WO 98/51183 provides a hair dye dispenser (1) for dispensing a fluid hair dye. Dispenser (1) includes a dispensing container (3), formed with a base and a side wall, for containing and dispensing the hair dye. The base is provided with a number of projecting tines (11) and dispensing apertures (15). A piston (17) slides in abutment with the wall of the dispensing container. The dispenser (1) also includes a housing for receiving the dispensing container (3) and an actuation mechanism for displacing the piston (17) towards the base so as to dispense the hair dye through the dispensing apertures (15).

While providing a highly convenient and effective method for applying dye to the hair, the aforementioned device has been found to suffer from certain limitations. Specifically, the device relies upon the user to fill the dispensing container with pre-mixed hair dye and then to position the piston within the container ready for use. This reliance on the user to correctly position and align the piston within the dispensing container has been found to be problematic. Even a relatively small misalignment of the piston may present a risk of seepage or squirting of the dye which could damage clothing or furnishings and which is generally inconvenient. A more extreme misalignment could possibly lead to breakage of the piston or dispensing container.

There is therefore a need for a cartridge for use with a hair dye dispenser which allows the user to fill the cartridge with minimum risk of leakage or misalignment. It would also be highly advantageous to provide a cartridge with a nozzle configuration which would provide convenient, effective distribution for a wide range of dye compositions.

SUMMARY OF THE INVENTION

The present invention is a cartridge for use with a hair dye dispenser and a method of using such a cartridge.

According to the teachings of the present invention there is provided, a cartridge for use in a hair dye dispenser, the cartridge comprising: (a) a dispensing container for containing and dispensing the hair dye, the dispensing container having a base and at least one side wall sealingly interconnected with the base so as to define an internal volume of the dispensing container, the base having a lower surface which is formed with a plurality of projecting tines, at least one dispensing aperture being formed through the base; and (b) a piston configured to fit closely in sliding abutment with the at least one side wall so as to be sealingly slidable towards the base, wherein the at least one dispensing aperture is implemented as a dispensing channel along at least one of the projecting tines, the at least one of the projecting tines having an axis and a tip, the dispensing channel including: (i) a central channel extending within the tine parallel to the axis; and (ii) at least one lateral dispensing opening located adjacent to the tip in such a manner as to leave closed a region of the tip adjacent to the axis, the at least one lateral dispensing opening being in fluid connection with the central channel.

According to a further feature of the present invention, the at least one lateral dispensing opening extends to no more than about 8 mm from the tip as measured parallel to the axis.

According to a further feature of the present invention, a part of the at least one lateral dispensing opening closest to the tip lies within about 5 mm from the tip as measured parallel to the axis.

According to a further feature of the present invention, the at least one lateral dispensing opening has a dispensing area, and wherein the central channel has a given effective cross-sectional area adjacent to the at least one lateral dispensing opening, the effective cross-sectional area being at least about equal to the dispensing area.

According to a further feature of the present invention, the at least one lateral dispensing opening is implemented as a pair of lateral dispensing openings located on opposite sides of the tip.

There is also provided according to the teachings of the present invention, a cartridge for use in a hair dye dispenser, the cartridge comprising: (a) a dispensing container for containing and dispensing the hair dye, the dispensing container having a base and at least one side wall sealingly interconnected with the base so as to define an internal volume of the dispensing container, the base having a lower surface which is formed with a plurality of projecting tines, at least one dispensing aperture being formed through the base, the base further including a threaded filling aperture; (b) a threaded sealing element having a complementary threaded form configured to be selectively engagable within and removable from the threaded filling aperture to allow introduction of at least one dye component into the cartridge, the threaded sealing element further including a plurality of projecting tines; and (c) a piston configured to fit closely in sliding abutment with the at least one side wall so as to be sealingly slidable towards the base.

According to a further feature of the present invention, at least one of the projecting tines of the threaded sealing element includes a dispensing channel formed along a major part of a length of the projecting tine.

According to a further feature of the present invention, there is also provided piston alignment features associated with the as least one side wall for defining a starting position of the piston, the filling aperture being configured to facilitate access to the piston so as to allow the piston to be urged manually against the alignment features to assume the starting position.

According to a further feature of the present invention, the piston alignment features are provided by a shield element configured for clip-on engagement with the at least one wall.

According to a further feature of the present invention, the shield element at least partially overlies the piston.

According to a further feature of the present invention, the shield element is substantially annular, having a central opening to allow external application of pressure on the piston and extending around substantially the entirety of the at least one side wall.

According to a further feature of the present invention, the at least one dispensing aperture is implemented as a dispensing channel along one of the projecting tines.

There is also provided according to the teachings of the present invention, a cartridge for use in a hair dye dispenser, the cartridge comprising: (a) a dispensing container for containing and dispensing the hair dye, the dispensing container having a base and at least one side wall sealingly interconnected with the base so as to define an internal volume of the dispensing container, the base having a lower surface which is formed with at least eight projecting tines, each of the tines including a dispensing channel in fluid communication with the internal volume extending along a major part of the tine; and (b) a piston configured to fit closely in sliding abutment with the at least one side wall so as to be sealingly slidable towards the base, wherein the at least eight projecting tines are located such that a majority of the projecting tines lie on a circle and a minority of the projecting tines are displaced from the circle so as to define at least one substantially straight row of the tines.

According to a further feature of the present invention, there is also provided at least one supplementary projecting tines located in a central region within the circle.

According to a further feature of the present invention, the at least one supplementary projecting tine is formed as part of a removable plug removably engagable with the base.

According to a further feature of the present invention, the at least one substantially straight row of the tines is implemented as two substantially straight rows of the tines located symmetrically around the circle.

According to a further feature of the present invention, the at least one wall is substantially cylindrical and is formed with at least one alignment feature configured for facilitating alignment of the cartridge in a predefined orientation in a hair dye dispenser.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
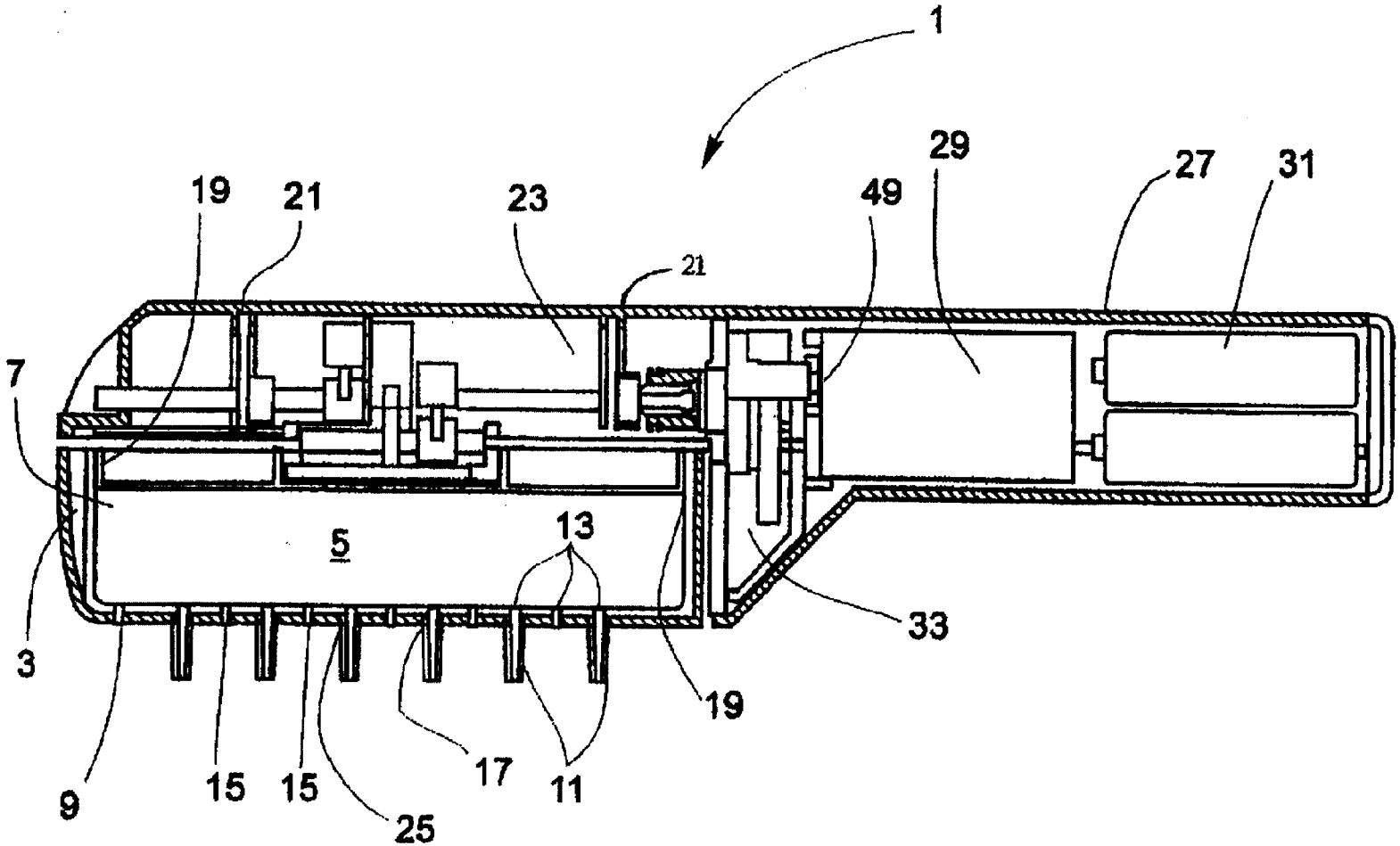
Fig. 1 (PRIOR ART)
FIG. 1 is a side cross-sectional view of a conventional hair dye dispenser corresponding to FIG. 2 of PCT Patent Publication No. WO98/51183.

The present invention is a cartridge for use with a hair dye dispenser.

The principles and operation of hair dye cartridges according to the present invention may be better understood with reference to the drawings and the accompanying description.

Referring now to the drawings, FIGS. 2–5 show a preferred implementation of a cartridge, constructed and operative according to the teachings of the present invention, for use with a hair dye dispenser. The function of the cartridge when placed within a hair dye dispenser is essentially similar to that of the dispensing container and piston combination described in the aforementioned PCT Patent Publication No. WO98/51183, with certain exceptions that will be described below. Accordingly, the cartridge has a basic structure including a dispensing container 10 and a piston 12. In its most general form, dispensing container 10 is described as having a base 14 and at least one side wall 16 sealingly attached to or integrally formed with base 14 so as to define an internal volume of the dispensing container. Base 14 has a lower surface formed with a plurality of projecting tines 18. At least one dispensing aperture 20 is formed through base 14, preferably along at least part the length of one or more of the tines. Piston 12 is configured to fit closely in sliding abutment with the at least one side wall so as to be sealingly slidable towards base 14.

The particular features in which the cartridges of the present invention differ from the corresponding components of the aforementioned application relate primarily to features facilitating filling and use of the cartridge.

Before turning to the structural features of the cartridges of the present invention in detail, it should be appreciated that the present invention is useful in a wide range of applications in which a dispenser is used to apply fluid to the hair or scalp for coloring, tinting, bleaching or any other treatment. By way of example, the invention will be described in the context of a dispenser for applying hair dye. However, references to "dye" and "hair dye dispenser" are not to be construed to limit the claimed structures in any way.

It should noted that the term "fluid" is used herein in the description and claims to refer to any composition or mixture which flows such that it can be dispensed through dispensing apertures 20 under applied pressure. Examples of fluids according to this definition include, but are not limited to, liquids, suspensions, gels, creams and pastes of a wide range of thicknesses.

It will be clear that the present invention relates primarily, although not necessarily exclusively, to single-use cartridges which are either disposed of or recycled after use.

Turning now to the structural features of the cartridges of the present invention, dispensing container 10 and piston 12 are both preferably formed from polymer materials. Examples of appropriate materials include, but are not limited to, polypropylene and various plastics.

Figure 3:
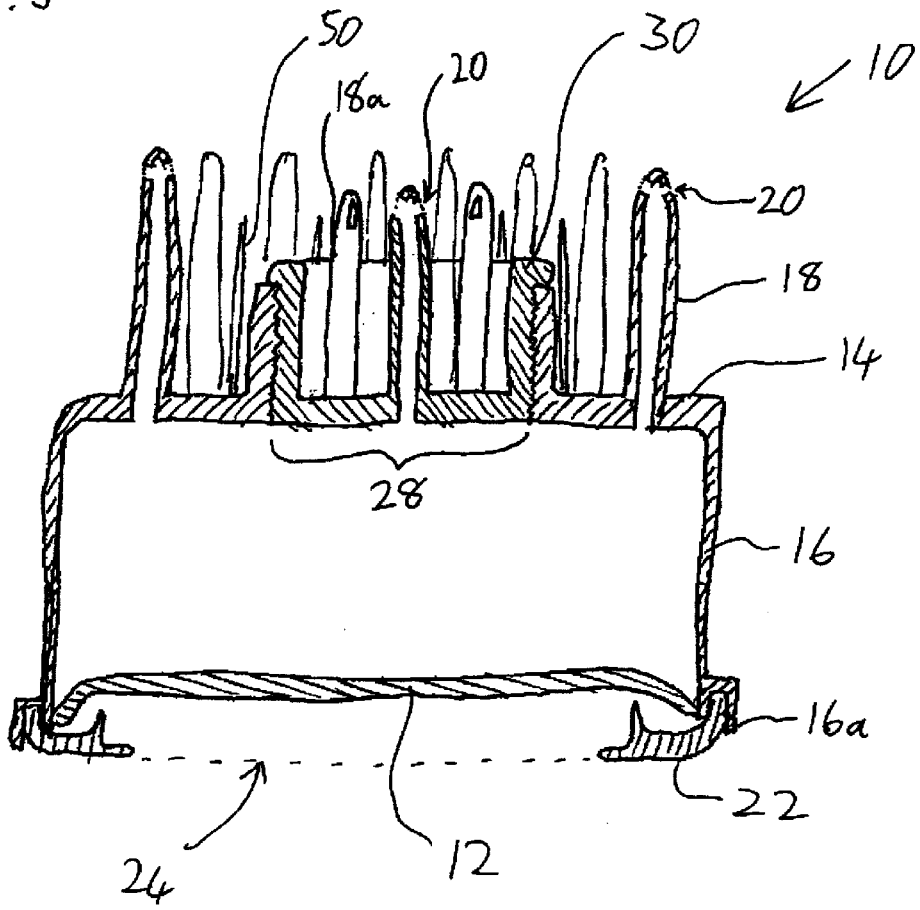
FIG. 3 is a side cross-sectional view taken through the cartridge of FIG. 2.

FIG. 3 shows a shield element 22 connected to side wall 16 so as to be deployed in overlying relation to at least part of piston 12. Since shield element 22 is supported directly by wall 16, any pressure or impact exerted upon the shield is redirected away from piston 12, thereby avoiding accidental misalignment of the piston after filling. The shield also serves to define a starting position of piston 12 as will be described further below.

Optionally, a number of separate shield elements 22 may be attached at positions spaced around side wall 16 so that each covers a different region of piston 12. Preferably, shield element 22 is substantially annular, extending around substantially the entirety of side wall 16 and having a central opening 24 through which pressure may be applied to the piston. Shield element 22 is preferably attached by a click-fit clip-on configuration as is well known in the art of molded plastic items. Most preferably, the perimeter of shield element 22 is substantially encompassed by a projecting lip 16*a* around the edge of side wall 16, thereby rendering it difficult to remove the shield manually. The shield remains in place during use of the cartridge within a dispenser without interfering with operation of the dispenser.

In principle, depending upon the treatment to be performed and the fluid to be dispensed from the cartridge, it may be possible to provide the cartridge to the user with the required components already inside. In the case of permanent hair dyes, this would require provisions for separate storage of two or more components within the container and subsequent mixing prior to use. While such provisions may be implemented using frangible dividers between separate compartments, they are considered unnecessarily complex and expensive for the present invention. Instead, preferred embodiments of the present invention provide a sealable filling aperture 28 for introducing one or more component into the cartridge.

Clearly, sealable filling aperture 28 could be implemented in many locations and configurations in the cartridge. In the preferred case of a cylindrical or otherwise curved side wall 16, the side wall is preferably not used for the filling aperture due to the difficulty of ensuring a proper seal around the piston. A circumferential threaded connection subdividing wall 16 may be used. Other implementations such as with a straight-sided cartridge (square, rectangular, polygonal or other) may facilitate inclusion of aperture 28 with an appropriate sealing element in a side wall. Preferably, however, filling aperture 28 is implemented either within piston 12 or as part or all of base 14. Aperture 28 and sealing element 30 preferably feature complementary threading to facilitate removal and resealing of sealing element 30 by the user.

Figure 2:
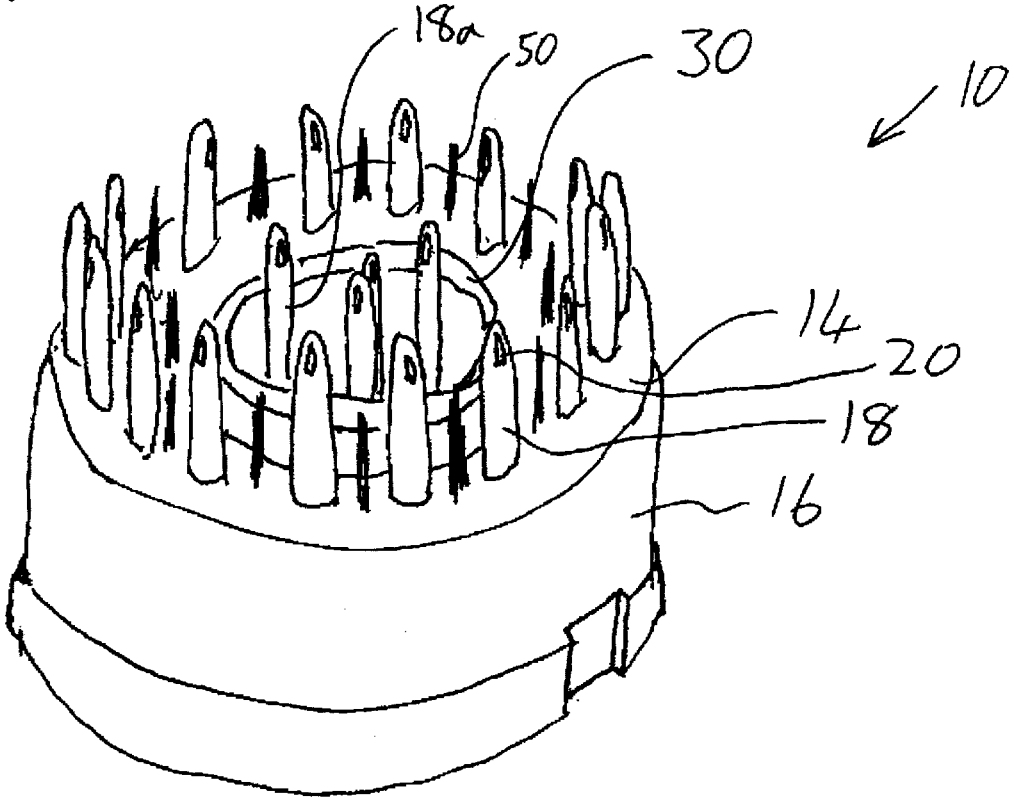
FIG. 2 is a schematic isometric view of a preferred implementation of a cartridge for use in a hair dye dispenser, constructed and operative according to the teachings of the present invention.
Figure 4:
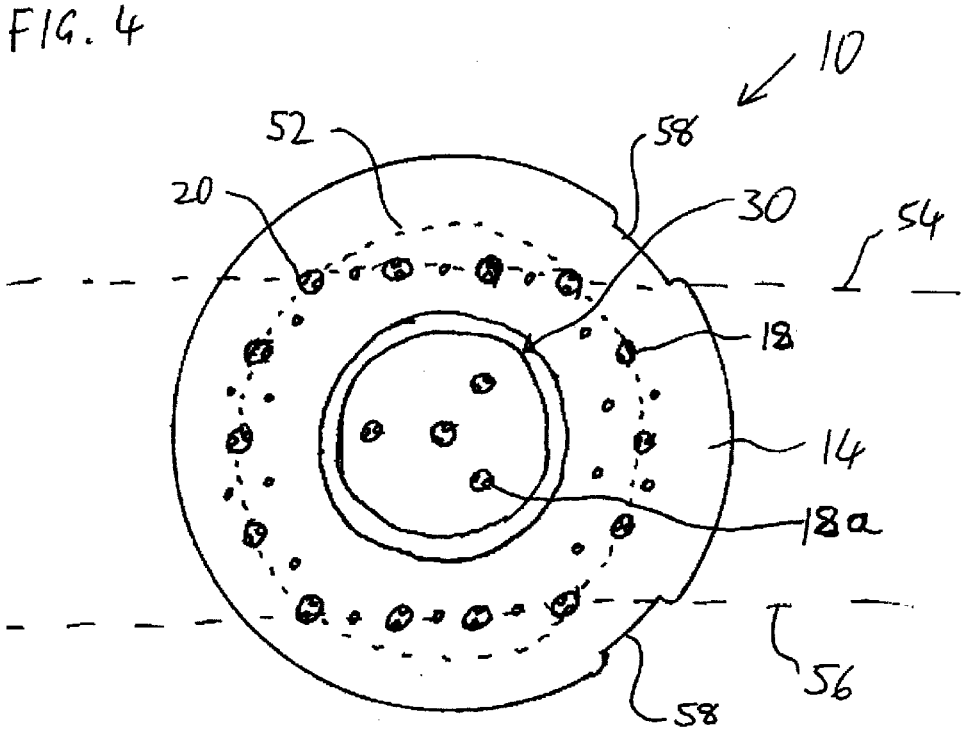
FIG. 4 is a plan view of the cartridge of FIG. 2.

FIGS. 2–4 show a most preferred implementation of the cartridge of the present invention in which base 14 features a filling aperture 28 with complementary removable sealing element 30 to allow introduction of at least one dye component into the cartridge. This choice allows the container to be placed on a surface, or more preferably within a dispenser device, prior to filling with the dispensing apertures pointing upwards during filling. This helps ensure that no dye leaks from the apertures during the filling process. Additionally, aperture 28 is preferably configured to facilitate access to piston 12 so as to allow the piston to be urged manually against alignment features, in this case provided by shield 22, which define a starting position of piston 12. In this way, container 10 can be manufactured without requiring precise pre-alignment of the piston. Instead, the user is instructed to push the piston "down as far as it goes" as the first step of the filling procedure, thereby ensuring correct initial alignment of the piston prior to filling.

The position and configuration of aperture 28 must be chosen so as not to conflict with, or be obstructed by, the positioning of tines 18 and dispensing apertures 20. This may be achieved by rendering substantially the entire base 14 removable such that all of tines 18 and dispensing apertures 20 may be considered part of sealing element 30, by subdividing tines 18 and/or dispensing apertures 20 between sealing element 30 and the remainder of base 14, or by forming aperture 28 and sealing element 30 in a region of base 14 free from tines 18 and dispensing apertures 20.

In the particularly preferred case illustrated here, a primary group of dispensing tines are located in a substantially circular pattern (to be described further below) around base 14. This preferred distribution of tines 18 and dispensing apertures 20 over base 14 typically leaves a central region of base 14 free and readily accessible, making this the preferred position for aperture 28 as illustrated in FIGS. 2–4. Advantageously, an additional group of tines 18*a* is formed as part of sealing element 30. These tines are preferably configured to facilitate manual gripping of the sealing element 30 for the positioning and rotation required for removal and insertion of the sealing element. Where additional tines 18*a* are further provided with dispensing apertures 20 as shown here, they are also valuable for providing more efficient delivery of dye to the hair.

Figure 5B:
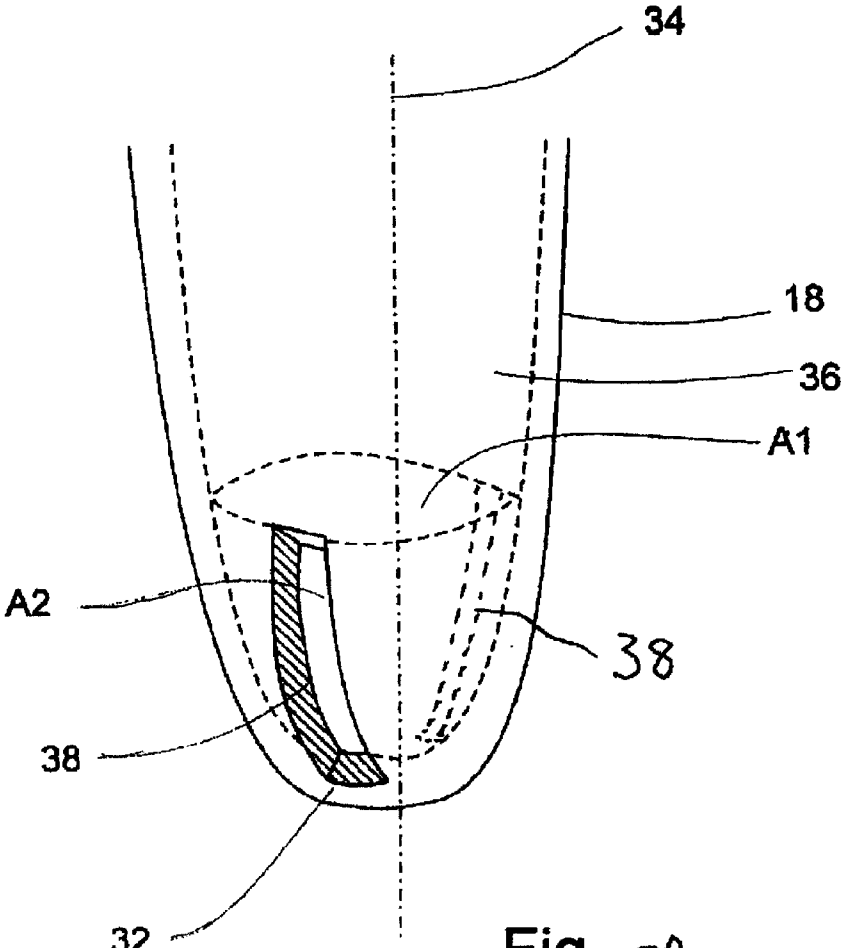
FIGS. 5A and 5B are enlarged isometric views of the end portion of two preferred forms of a tine formed with a dispensing aperture for use in the cartridges of the present invention.
Figure 5A:
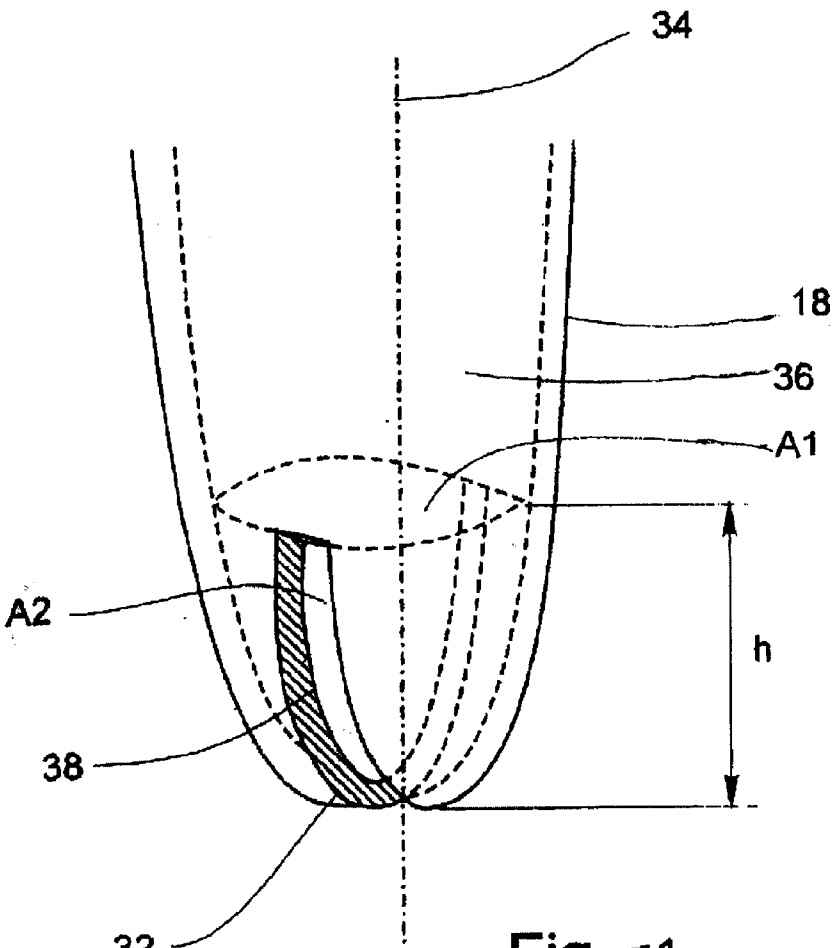

In this context, it will be useful to describe preferred configurations for tines 18 and dispensing apertures 20 illustrated in FIGS. 5A and 5B. Preferably, at least one, and typically all, of dispensing apertures 20 are implemented as channels along the length of projecting tines 18. This ensures effective delivery of the hair dye down to the root portion of the hair where it is typically most needed. However, it is thought that a simple axial channel terminating at the tip of the tine produces a non-optimal distribution of dye in the hair and may even suffer from occlusion due to close proximity with the scalp during use. The aspect of the present invention illustrated in FIGS. 5A and 5B offers a solution to this problem. It is important to note that this aspect of the present invention is not limited to the context of the remaining features of the cartridges of the present invention and could in fact be used to advantage in an otherwise conventional dispensing container.

Turning now first to FIG. 5A, there is shown a tip 32 of a tine 18, which is shown to have an axis 34 parallel to its length. In this implementation, the dispensing channel includes a central channel 36 extending within tine 18 parallel to axis 34 and a dispensing slot 38 formed through tine 18 adjacent to its tip 32 so as to intersect with central channel 36. It is a particular feature of this aspect of the present invention that an effective cross-sectional area A1 of central channel 36 proximal to slot 38 is at least about equal to the total dispensing area A2 of slot 38. This ensures that the local flow capacity of central channel 36 is at least equal to that of dispensing slot 38 so that the dye is released substantially uniformly along the length of the slot.

It will be apparent that the "effective cross-sectional area" A1 of central channel 36 for the purpose of this definition is the cross-sectional area taken perpendicular to the flow direction where the flow first intersects dispensing slot 38. Typically, this corresponds to the maximum area of the central channel measured perpendicular to axis 34 at a position adjacent to the slot. The "dispensing area" A2 for a regular rectangular slot 38 is simply the product of the length of the slot and its breadth as measured over the surface of tine 18.

The advantageous effects of dispensing slot 38 are most pronounced when the slot extends from tip 32 into tine 18 to a "height" h of at least about 2 mm, and preferably between about 3 and about 8 mm, as measured parallel to axis 34. This gives a flow characteristic that has been found to be highly effective for rapidly achieving a uniform distribution of fluid through the hair of the user. Values of h above about 1 cm are usually not required. The breadth of slot 38, which is generally independent of the required height h, is preferably chosen according to the thickness/viscosity of the fluid to be dispensed.

FIG. 5B illustrates a more preferred dispensing configuration. Specifically, in this case, central channel 36 is in fluid connection with at least one lateral dispensing opening 38 located adjacent to tip 32 in such a manner as to leave closed a region of tip 32 adjacent to axis 34. Parenthetically, it will be apparent from this definition that the term "adjacent to tip 32" does not necessarily, or even preferably, imply extending all the way to the tip. In many cases it has been found advantageous that at least the region of tip 38 adjacent to axis 34 is closed. This form further helps to direct the dispensed dye effectively into the hair by reducing the quantity of dye which is smeared directly onto the scalp. Furthermore, this "closed end" configuration has been found suitable for a very wide range of dye compositions, tending to minimize problems of dripping for even the most "runny" consistencies. Thus, FIG. 5B shows a tine 18 similar to that of FIG. 5A but with one or more dispensing slot 38 deployed adjacent to, but without reaching, tip 32. In a most preferred implementation, two slots 38 are employed on opposite sides of the tine, approximating to the single elongated slot of FIG. 5A but with a closed region at tip 32. The closed region preferably corresponds to no more than the 5 mm closest to tip 32, and most preferably no more than about 3 mm. In the case of two or more slots 38, the dispensing area A2 is clearly the sum total of the dispensing areas of the individual slots. The preferred parameters (maximum values of h from the tip, A1 at least equal to A2 etc.) described with reference to FIG. 5A hold true equally for this implementation.

It should be noted that the tines of dispensing container 10 need not all be implemented as dispensing tines. For example, in the case illustrated here, tines 18 and 18*a* are supplemented by a plurality of simple tines or teeth 50 which help to spread the dye evenly through the hair and to separate hairs which may be grouped together.

Referring now particularly to FIG. 4, a further preferred feature is that at least one group of dispensing apertures 20 are distributed substantially around the periphery of base 14, and preferably, substantially evenly spaced around a substantially circular line 52. With preferably between about 8 and about 20 tines formed with dispensing apertures, this renders the distribution of dye roughly uniform over the area swept through by the dispenser independent of the direction in which the dispenser is moved. As a result, the user does not need to be particular about the angle at which the dispenser is held relative to the direction of brushing in the dye.

While a majority of dispensing tines 18 preferably lie on circle 52, a minority of them are preferably displaced from circle 52 so as to define at least one substantially straight row 54, 56 of tines 18. Each straight row preferably includes at least three, and most preferably at least four, tines 18. These straight rows are helpful for allowing a user to start or finish a dye-dispensing stroke at the hair-line (for example, the front of the crown at the junction with the forehead) without applying dye to the skin beyond the hair-line. It should be noted that the "substantially straight rows" need only be sufficiently straight for the stated function. Specifically, the substantially straight rows preferably have a radius of curvature no less than about 10 cm, and preferably at least about 15 cm. Such a curvature is reasonably considered "substantially straight" over a length of no more than a few centimeters and compared to a radius of curvature for circle 52 in the range 3–5 cm.

Preferably, two substantially straight rows 54 and 56 are provided to accommodate right-handed and left-handed users and/or for the beginning and end of a stroke. The relatively small displacement from circle 52 is such that the aforementioned advantages of the circular configuration are largely maintained.

As mentioned before, the outer circle of dispensing tines 18 are optionally supplemented by one or more supplementary projecting tines 18*a* located in a central region within the circle, most preferably as part of sealing element 30 which is implemented as a removable plug removably engagable with base 14.

In order to ensure that straight rows are correctly located when dispensing container 10 is inserted in a dispenser device, wall 16 is preferably provided with at least one alignment feature 58 configured for facilitating alignment of the cartridge in a predefined orientation in a hair dye dispenser. In the case shown here, alignment features 58 are implemented as slots formed in projecting lip 16*a,* although a range of other functionally equivalent alignment features are well within the capabilities of one ordinarily skilled in the art.

To complete the structural description of the cartridges of the present invention, it should be noted that dispensing container 10 need not assume a symmetrical cylindrical form. Examples of other possible shapes of base 14 include, but are not limited to, elliptical, square, rectangular and other regular or irregular polygonal shapes. Furthermore, although side wall(s) 16 are typically perpendicular to base 14, this is not a necessary condition. Similarly, for different applications and types of hair, the design, spacing and number of dispensing apertures may be varied considerably. By way of example, one alternative aperture design employs a single elongated slit along a major part of base 14 to dispense the dye.

Additionally, the dimensions of dispensing container 10 are preferably chosen such that the dye can be dispensed over a relatively large area simultaneously, while minimizing the height dimension so that the dispenser can be kept as compact as possible. To this end, a major dimension of the base designated "length" is preferably at least about twice the "height" defined as the dimension of side wall 16 measured perpendicular to the length. In a preferred implementation in which base 14 is round and side wall 16 is correspondingly a single substantially cylindrical wall, the "length" will correspond to the internal diameter of wall 16.

Turning now to the use of the cartridges of the present invention and certain accessories for facilitating that use, it will be noted that there are a number of options as to the sequence of mixing of dye components and filling of the cartridge. Optionally, one dye component may be supplied already within the cartridge. In this case, sealing element 30 is removed and the remaining one or more components are inserted into the cartridge through filling aperture 28. Sealing element 30 is then replaced and the cartridge shaken to mix the components until the cartridge is ready for use. Parenthetically, it is noted that the use of relatively transparent materials such as polypropylene for the cartridge is advantageous in this regard since it allows the user to see whether the dye has been sufficiently mixed for use.

Referring again briefly to FIG. 2, there is shown a lower sealing layer 40 which includes a number of shaped seals 42 for sealing dispensing apertures 20 prior to use. Some degree of sealing is required in most applications to prevent seepage occurring between filling of the cartridge and the start of operation. A higher degree of sealing is required when one of the components is stored within the cartridge for an extended period prior to use. The required sealing can readily be achieved using shaped seals 42 in the form of foil coverings, small plug elements or by any other conventional sealing means or combination thereof. The implementation of sealing layer 40 in the form of a plate of diameter slightly greater than the widest spacing of dispensing apertures 20 serves an additional purpose, catching any drips of dye which may be released during priming of the dispenser before the device is positioned against the head of the user. In the case that filling aperture 28 is located within base 14 as shown in FIGS. 4 and 6, an annular implementation of sealing layer 40 may provide an equivalent function.

An alternative filling option is that all components are provided separately from the cartridge, to be mixed either prior to or after insertion into the cartridge. In this case, the components may be supplied in separate conventional packaging for manual filling of the cartridge. It is noted, however, that the conventional packaging for dye pigments, namely, squeezable tubes, are far from ideal due to the considerable dead-volume wastage. Furthermore, the user is relied upon to provide the correct proportions of each of the components in turn. To avoid these problems, a two-component storage and filling device for storage and controlled release of correct proportions of two dye components in a single operation may optionally be provided. Devices of this type are described in the parent applications to the present application, and will not be described further herein.

It will be appreciated that the above descriptions are intended only to serve as examples, and that many other embodiments are possible within the spirit and the scope of the present invention.

What is claimed is:

1. A cartridge for use in a hair dye dispenser, the cartridge comprising:

(a) a dispensing container for containing and dispensing the hair dye, said dispensing container having a base and at least one side wall sealingly interconnected with said base so as to define an internal volume of said dispensing container, said base having a lower surface which is formed with a plurality of projecting tines, at least one dispensing aperture being formed through said base; and (b) a piston configured to fit closely in sliding abutment with said at least one side wall so as to be sealingly slidable towards said base, wherein said at least one dispensing aperture is implemented as a dispensing channel along at least one of said projecting tines, said at least one of said projecting tines having an axis and a tip, said dispensing channel including:

(i) a central channel extending within said tine parallel to said axis; and (ii) at least one lateral dispensing opening located adjacent to said tip in such a manner as to leave closed a region of said tip adjacent to said axis, said at least one lateral dispensing opening being in fluid connection with said central channel.

2. The cartridge of claim 1, wherein said at least one lateral dispensing opening extends to no more than about 8 mm from said tip as measured parallel to said axis.

3. The cartridge of claim 1, wherein a part of said at least one lateral dispensing opening closest to said tip lies within about 5 mm from said tip as measured parallel to said axis.

4. The cartridge of claim 1, wherein said at least one lateral dispensing opening has a dispensing area, and wherein said central channel has a given effective cross-sectional area adjacent to said at least one lateral dispensing opening, said effective cross-sectional area being at least about equal to said dispensing area.

5. The cartridge of claim 1, wherein said at least one lateral dispensing opening is implemented as a pair of lateral dispensing openings located on opposite sides of said tip.

6. A cartridge for use in a hair dye dispenser, the cartridge comprising:

(a) a dispensing container for containing and dispensing the hair dye, said dispensing container having a base and at least one side wall sealingly interconnected with said base so as to define an internal volume of said dispensing container, said base having a lower surface which is formed with a plurality of projecting tines, at least one dispensing aperture being formed through said base, said base further including a threaded filling aperture;

(b) a threaded sealing element having a complementary threaded form configured to be selectively engagable within and removable from said threaded filling aperture to allow introduction of at least one dye component into the cartridge, said threaded sealing element further including a plurality of projecting tines; and (c) a piston configured to fit closely in sliding abutment with said at least one side wall so as to be sealingly slidable towards said base.

7. The cartridge of claim 6, wherein at least one of said projecting tines of said threaded sealing element includes a dispensing channel formed along a major part of a length of said projecting tine.

8. The cartridge of claim 6, further comprising piston alignment features associated with said as least one side wall for defining a starting position of said piston, said filling aperture being configured to facilitate access to said piston so as to allow said piston to be urged manually against said alignment features to assume said starting position.

9. The cartridge of claim 8, wherein said piston alignment features are provided by a shield element configured for clip-on engagement with said at least one wall.

10. The cartridge of claim 9, wherein said shield element at least partially overlies said piston.

11. The cartridge of claim 10, wherein said shield element is substantially annular, having a central opening to allow external application of pressure on said piston and extending around substantially the entirety of said at least one side wall.

12. The cartridge of claim 6, wherein said at least one dispensing aperture is implemented as a dispensing channel along one of said projecting tines.

13. A cartridge for use in a hair dye dispenser, the cartridge comprising:

(a) a dispensing container for containing and dispensing the hair dye, said dispensing container having a base and at least one side wall sealingly interconnected with said base so as to define an internal volume of said dispensing container, said base having a lower surface which is formed with at least eight projecting tines, each of said tines including a dispensing channel in fluid communication with said internal volume extending along a major part of said tine; and (b) a piston configured to fit closely in sliding abutment with said at least one side wall so as to be sealingly slidable towards said base, wherein said at least eight projecting tines are located such that a majority of said projecting tines lie on a circle and a minority of said projecting tines are displaced from said circle so as to define at least one substantially straight row of said tines.

14. The cartridge of claim 13, further comprising at least one supplementary projecting tines located in a central region within said circle.

15. The cartridge of claim 14, wherein said at least one supplementary projecting tine is formed as part of a removable plug removably engagable with said base.

16. The cartridge of claim 13, wherein said at least one substantially straight row of said tines is implemented as two substantially straight rows of said tines located symmetrically around said circle.

17. The cartridge of claim 13, wherein said at least one wall is substantially cylindrical and is formed with at least one alignment feature configured for facilitating alignment of the cartridge in a predefined orientation in a hair dye dispenser.

* * * * *